US007742726B2

(12) United States Patent
Mase et al.

(10) Patent No.: US 7,742,726 B2
(45) Date of Patent: Jun. 22, 2010

(54) DEVELOPER CARTRIDGE, DEVELOPING UNIT AND IMAGE FORMING APPARATUS INCLUDING THE SAME

(75) Inventors: Soichiro Mase, Handa (JP); Ryuya Yamazaki, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 334 days.

(21) Appl. No.: 12/028,180

(22) Filed: Feb. 8, 2008

(65) Prior Publication Data

US 2008/0205939 A1 Aug. 28, 2008

(30) Foreign Application Priority Data

Feb. 27, 2007 (JP) ..... 2007-047473

(51) Int. Cl.
*G03G 15/08* (2006.01)

(52) U.S. Cl. ..... 399/263; 399/254

(58) Field of Classification Search ..... 399/262, 399/263, 254

See application file for complete search history.

(56) References Cited

U.S. PATENT DOCUMENTS

| | | | | |
|---|---|---|---|---|
| 6,526,245 | B1 * | 2/2003 | Yamashita | 399/254 |
| 7,634,218 | B2 * | 12/2009 | Sato | 399/263 |
| 2001/0046395 | A1 * | 11/2001 | Ashikari et al. | 399/262 |
| 2002/0034404 | A1 * | 3/2002 | Kojima et al. | |
| 2007/0223971 | A1 * | 9/2007 | Takagi | |
| 2008/0298836 | A1 * | 12/2008 | Sato | |

FOREIGN PATENT DOCUMENTS

| | | | |
|---|---|---|---|
| JP | 7-287448 | A | 10/1995 |
| JP | 09-319202 | | 12/1997 |
| JP | 11-024401 | A | 1/1999 |
| JP | 2002-229316 | A | 8/2002 |
| JP | 2006-058446 | A | 3/2006 |

OTHER PUBLICATIONS

JP Office Action dtd Mar. 5, 2009, JP Appln. 2007-047473, partial English translation.

* cited by examiner

*Primary Examiner*—Susan S Lee
(74) *Attorney, Agent, or Firm*—Banner & Witcoff, Ltd.

(57) ABSTRACT

A developer cartridge, developing unit, and image forming apparatus are provided. The developer cartridge includes a cartridge cabinet including a developer accommodate chamber, a supply opening, and a return opening. The developer cartridge further includes a rotational shaft that is rotatably supported in the cartridge cabinet, a first agitating blade that is attached to the rotational shaft and that is located in a position opposed to the return opening, a distance from the rotational shaft to a distal end of the first agitating blade being shorter than a distance from the rotational shaft to the return opening, and a second agitating blade that is attached to the rotational shaft and that is located in a position opposed to the supply opening, a distance from the rotational shaft to a distal end of the second agitating blade being longer than a distance from the rotational shaft to the supply opening.

12 Claims, 11 Drawing Sheets

DEVELOPER CARTRIDGE, DEVELOPING UNIT AND IMAGE FORMING APPARATUS INCLUDING THE SAME

CROSS-REFERENCE TO RELATED APPLICATIONS

This application claims priority from Japanese Patent Application No. 2007-047473 filed on Feb. 27, 2007, the entire subject matter of which is incorporated herein by reference.

TECHNICAL FIELD

Aspects of the present invention relate to an image forming apparatus, a developing unit, and a developer cartridge mounted in the image forming apparatus for supplying developer.

BACKGROUND

There has been proposed a laser printer including a toner replenishment method for replenishing a developing device from a toner cartridge with toner (for example, see JP-A-9-319202).

In the laser printer including the toner replenishment method, the toner cartridge is configured attachably to and detachably from an inside of the developing device. In a state of attaching the toner cartridge to the developing device, an inside of the toner cartridge communicates with an inside of a developing chamber of the developing device by a toner supply opening provided in a center in a width direction of the toner cartridge and by toner suction openings provided on both sides of the supply opening. An agitator for supplying toner from the toner supply opening to the inside of the developing chamber while agitating the toner is disposed inside the toner cartridge. Inside the developing chamber, a developing roller, a supply roller for supplying toner to the developing roller, and an developer transport member for transporting toner are arranged. The toner supplied from the toner supply opening to the inside of the developing chamber is transported from the toner supply opening toward each of the toner suction openings on either side of the supply opening of the toner cartridge by the developer transport member of the developing chamber. Then, the toner is returned from each of the toner suction openings to the inside of the toner cartridge. Consequently, the toner can be deposited uniformly along the whole supply roller while the toner circulates between the toner cartridge and the developing chamber, and the toner is prevented from being retained in a part of the inside of the developing chamber.

SUMMARY

Aspects of the present invention provide a developer cartridge, a developing unit and an image forming apparatus capable of ensuring smooth circulation of developer between a developer accommodate chamber and an outside thereof.

DETAILED DESCRIPTION

General Overview

Figure 1:
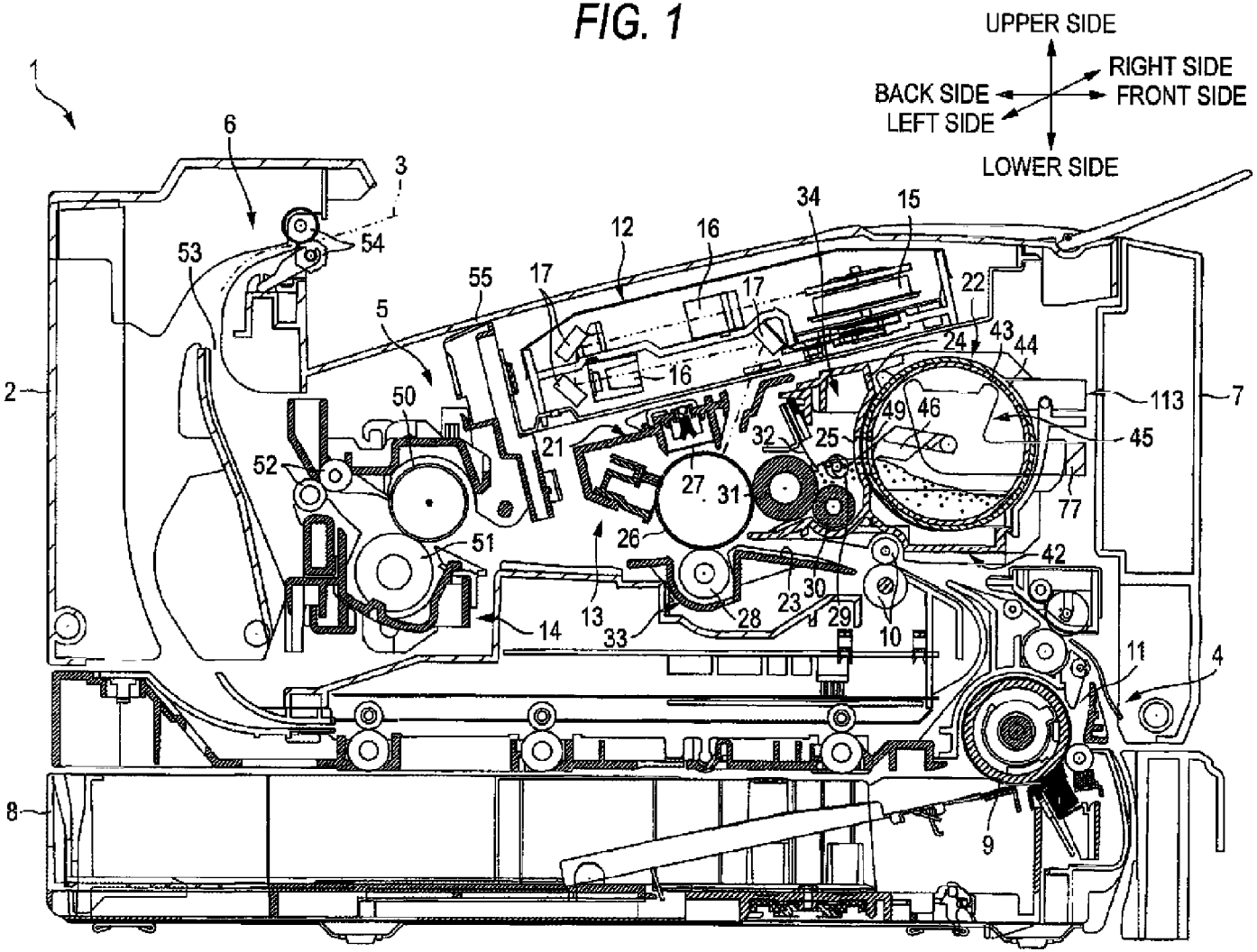
FIG. 1 is an exemplary side sectional view showing an image forming apparatus according to an aspect of the present invention.

According to an aspect of the present invention, there is provided a developer cartridge including a cartridge cabinet comprising a wall surface; a developer accommodate chamber that accommodates developer; a supply opening that is provided in the wall surface and supplies the developer from an inside of the developer accommodate chamber to an outside of the developer accommodate chamber; and a return opening that is provided in the wall surface and returns the developer from the outside of the developer accommodate chamber to the inside of the developer accommodate chamber; wherein the developer cartridge further comprises a rotational shaft that is rotatably supported in the cartridge cabinet, extends parallel to the wall surface and penetrates through the inside of the developer accommodate chamber; a first agitating blade that is attached to the rotational shaft to rotate with the rotational shaft and that is located in a position opposed to the return opening, a distance from the rotational shaft to a distal end of the first agitating blade being shorter than a distance from the rotational shaft to the return opening in a region overlapping the return opening; and a second agitating blade that is attached to the rotational shaft to rotate with the rotational shaft and that is located in a position opposed to the supply opening, a distance from the rotational shaft to a distal end of the second agitating blade being longer than a distance from the rotational shaft to the supply opening.

According to another aspect of the present invention, there is provided a developing unit including a developer cartridge comprising a cartridge cabinet comprising a wall surface; a developer accommodate chamber that accommodates developer; a supply opening that is provided in the wall surface and supplies the developer from an inside of the developer accommodate chamber to an outside of the developer accommodate chamber; and a return opening that is provided in the wall surface and returns the developer from the outside of the developer accommodate chamber to the inside of the developer accommodate chamber; wherein the developer cartridge further comprises a rotational shaft that is rotatably supported in the cartridge cabinet, extends parallel to the wall surface and penetrates through the inside of the developer accommodate chamber; a first agitating blade that is attached to the rotational shaft to rotate with the rotational shaft and that is located in a position opposed to the return opening, a distance from the rotational shaft to an distal end of the first agitating blade being shorter than a distance from the rotational shaft to the return opening in a region overlapping the return opening; and a second agitating blade that is attached to the rotational shaft to rotate with the rotational shaft and that is located in a position opposed to the supply opening, a distance from the rotational shaft to a distal end of the second agitating blade being longer than a distance from the rotational shaft to the supply opening; and wherein the developing unit further comprises a unit cabinet which is attachable to and detachable from the developer cartridge, the unit cabinet comprising a developing chamber; and a plurality of openings that are provided in a wall surface of the unit cabinet, a respective one of the plurality of openings located in a position opposite to the supply opening and the return opening of the developer cartridge enable communication between an inside of the developing chamber to the inside of the developer accommodate chamber; and a developer transport member that is provided inside the developing chamber and transports developer supplied from the supply opening to the inside of the developing chamber in a direction along the rotational shaft.

According to still another aspect of the present invention, there is provided an image forming apparatus including an apparatus body comprising a developing unit comprising a developer cartridge comprising a cartridge cabinet comprising a wall surface; a developer accommodate chamber that accommodates developer; a supply opening that is provided in the wall surface and supplies the developer from an inside of the developer accommodate chamber to an outside of the developer accommodate chamber; and a return opening that is provided in the wall surface and returns the developer from the outside of the developer accommodate chamber to the inside of the developer accommodate chamber; wherein the developer cartridge further comprises a rotational shaft that is rotatably supported in the cartridge cabinet, extends parallel to the wall surface and penetrates through the inside of the developer accommodate chamber; a first agitating blade that is attached to the rotational shaft to rotate with the rotational shaft and that is located in a position opposed to the return opening, a distance from the rotational shaft to an distal end of the first agitating blade being shorter than a distance from the rotational shaft to the return opening in a region overlapping the return opening; and a second agitating blade that is attached to the rotational shaft to rotate with the rotational shaft and that is located in a position opposed to the supply opening, a distance from the rotational shaft to a distal end of the second agitating blade being longer than a distance from the rotational shaft to the supply opening; and wherein the developing unit further comprises a unit cabinet which is attachable to and detachable from the developer cartridge, the unit cabinet comprising a developing chamber; and a plurality of openings that are provided in a wall surface of the unit cabinet, a respective one of the plurality of openings located in a position opposite to the supply opening and the return opening of the developer cartridge enable communication between an inside of the developing chamber to the inside of the developer accommodate chamber; and a developer transport member that is provided inside the developing chamber and transports developer supplied from the supply opening to the inside of the developing chamber in a direction along the rotational shaft.

<Illustrative Aspects>

Illustrative aspects of the invention will be described with reference to the drawings.

In the related laser printer including the developer replenishment method described above suffers from a number of disadvantages. First, in practice, toner in the vicinity of the toner suction openings is subjected to force from the agitator. Moreover, the toner is also supplied from the toner suction openings to the inside of the developing chamber and thereby, smooth circulation of the toner between the toner cartridge and the developing chamber is prevented.

Aspects of the present invention provide a developer cartridge, a developing unit and an image forming apparatus capable of ensuring smooth circulation of developer between a developer accommodate chamber and an outside thereof.

(Image Forming Apparatus)

FIG. 1 is an exemplary side sectional view showing an image forming apparatus according to an aspect of the present invention. In FIG. 1, the image forming apparatus is embodied in the form of a laser printer by way of an example. However, one of ordinary skill in the art will appreciate that the present inventive concept will apply equally to any apparatus which uses developer for producing images on a recording medium.

An image forming apparatus 1 comprises a feeder unit 4 for feeding a sheet 3, an image forming unit 5 for forming an image on the sheet 3, a sheet discharge part 6 for discharging the sheet 3, and a body casing 2 for housing the feeder unit 4, the image forming unit 5, and the sheet discharge part 6. The body casing 2 is one example of an apparatus body.

(1) Body Casing

The body casing 2 has a substantially box shape. An opening is provided in a sidewall of one side of the body casing 2. A front cover 7 for opening and closing the opening is provided in the sidewall of one side of the casing 2.

Incidentally, in the following description, aside (right side in FIG. 1) where the front cover 7 is provided is referred to as a front side (front face side) and an opposite side (left side in FIG. 1) is referred to as a back side (rear side). Also, in the description that follows, references to upper, lower, left, and right sides of the image forming apparatus 1 are the upper, lower, left and right sides as viewed from the front side of the image forming apparatus 1. Also, a developing unit 13 and a developer cartridge 22 (both described in more detail below) are similarly described using directions in reference to the front side of the image forming apparatus 1.

(2) Feeder Unit

The feeder unit 4 comprises a sheet feeding tray 8, a sheet feeding roller 9, a pair of resister rollers 10, and a sheet feeding path 11. An upper most sheet 3 from an inside of the sheet feeding tray 8 is fed to the sheet feeding path 11 by rotation of the sheet feeding roller 9. The fed sheet 3 is conveyed to the resister rollers 10 through the sheet feeding path 11. The resister rollers 10 feed the sheet 3 toward the image forming unit 5 at proper timing.

(3) Image Forming Unit

The image forming unit 5 comprises a scanner unit 12, a fixing part 14 and a developing unit 13. In FIG. 1, the developing unit 13 is embodied in the form of a process cartridge by way of an example. However, one of ordinary skill in the art will appreciate that the present inventive concept will apply equally to any unit which may be used for developing.

(3-1) Scanner Unit

The scanner unit 12 is arranged in an upper part of inside of the body casing 2. The scanner unit 12 includes a laser light emitting part (not shown), a polygon mirror 15, a lens 16 and a reflecting mirror 17. A laser beam based on data of an image to be formed on the sheet 3 is emitted from the scanner unit 12 and a surface of a photoconductive drum 26 described below is irradiated with its laser beam.

(3-2) Developing Unit

The developing unit 13 is arranged under the scanner unit 12. The developing unit 13 is attachable to and detachable from the body casing 2.

The developing unit 13 comprises a process frame 21 as one example of a unit cabinet, and the developer cartridge 22 is detachably attached to the process frame 21.

Figure 2:
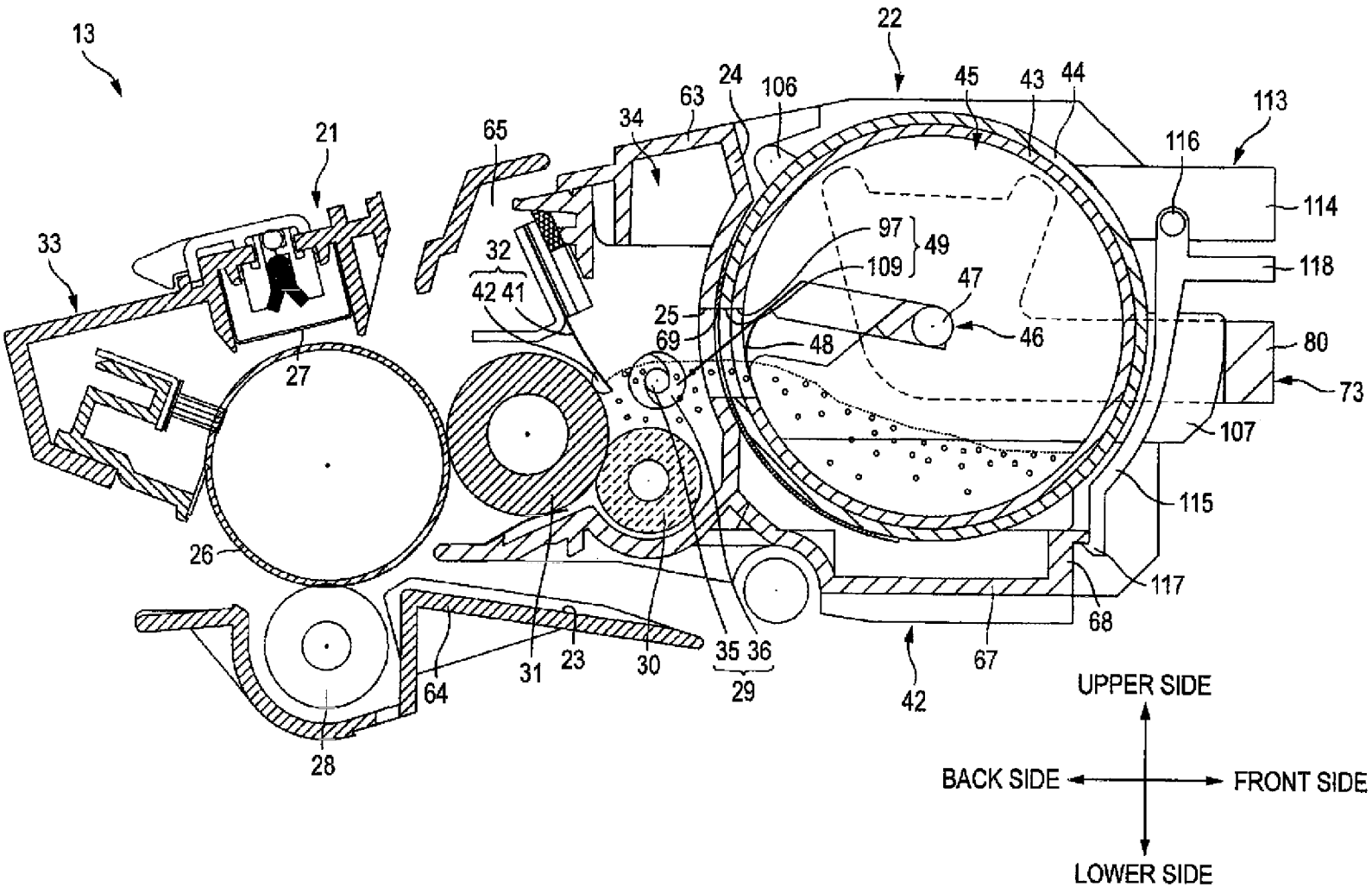
FIG. 2 is an exemplary side sectional view of a developing unit according to an aspect of the present invention wherein the developing unit is in a state in which a developer cartridge according to an aspect of the present invention is attached to a process frame.

FIG. 2 is an exemplary side sectional view of the developing unit 13 according to an aspect of the present invention.

The process frame 21 has a substantially box shape longitudinally in a width direction. A transfer path 23 for guiding the sheet 3 between a transfer roller 28 and the photoconductive drum 26 (described below) is provided in a lower part of the process frame 21.

In the process frame 21, a bulkhead 24 is provided in a middle part of front and back directions. The bulkhead 24 extends in upper and lower directions and in a width direction (left and right directions). A frame side opening 25 is provided in the bulkhead 24.

In the process frame 21, a portion of the process frame 21 on a back side from the bulkhead 24 is a process part 33 for receiving the photoconductive drum 26, an electrification device 27, the transfer roller 28, a developer transport member 29, a supply roller 30, a developing roller 31 and a layer thickness regulating blade 32. In FIG. 2, the developer transport member 29 is embodied in the form of an auger by way of example. However, one of ordinary skill in the art will appreciate that other structures are possible for transferring the developer.

The photoconductive drum 26 and the transfer roller 28 are rotatably supported by the process frame 21. The electrification device 27 is arranged over the photoconductive drum 26. The electrification device 27 may be, for example, a scorotron-type charger for positive electrification. The transfer roller 28 is arranged under the photoconductive drum 26.

A developing chamber 34 is provided inside the portion of about a half of front side of the process part 33. The developer transport member 29, the supply roller 30, the developing roller 31 and the layer thickness regulating blade 32 are arranged inside the developing chamber 34.

The developer transport member 29 is arranged in a position opposed to the frame side opening 25 in a back side of the frame side opening 25. The supply roller 30 is arranged under the developer transport member 29. The developing roller 31 is arranged at a back side of the supply roller 30. The developer transport member 29, the supply roller 30 and the developing roller 31 are rotatably supported by the process frame 21.

The layer thickness regulating blade 32 comprises a flexible leaf spring member 41 having a thin plate shape, and a pressure contact rubber 42 disposed at a lower end of the leaf spring member 41. An upper end of the leaf spring member 41 is fixed to the process frame 21 at upper side of the developing roller 31. The pressure contact rubber 42 presses a surface of a rubber roller 40 from the front side by an elastic force of the leaf spring member 41.

In the process frame 21, a portion of the process frame 21 on the front side of the bulkhead 24 forms a cartridge attachment part 42 to which a developer cartridge 22 is attached.

The developer cartridge 22 comprises an inside cabinet 43 and an outside cabinet 44. The inside cabinet 43 and the outside cabinet 44 form a double cylindrical shape in which both ends are closed.

The inside cabinet 43 as one example of a cartridge cabinet provides a developer accommodate chamber 45 for accommodating developer inside the inside cabinet 43. In the image forming apparatus 1 of the aspect, the developer comprises a suspension polymerization toner which is a nonmagnetic one-component toner with positive electrification.

Also, an agitator 46 is disposed inside the developer accommodate chamber 45. The agitator 46 is rotatably supported in the inside cabinet 43. The agitator 46 will be described below in detail.

A cartridge side opening 49 is provided in a surface of the inside cabinet 43 and a surface of the outside cabinet 44 as shown in FIG. 2. The cartridge side opening 49 allows an inside of the developer accommodate chamber 45 to communicate with an outside of the developer accommodate chamber 45 in a state in which the developer cartridge is attached to the cartridge attachment part 42.

Developer the inside of the developer accommodate chamber 45 is agitated by rotation of the agitator 46. Also, by rotation of the agitator 46, the developer of the inside of the developer accommodate chamber 45 is transported to the cartridge side opening 49 and is discharged from the cartridge side opening 49. The developer discharged from the cartridge side opening 49 is supplied to the inside of the developing chamber 34 through the frame side opening 25. The developer supplied to the inside of the developing chamber 34 is supplied to the supply roller 30 while being transported in a width direction by rotation of the developer transport member 29.

The developer supplied to the supply roller 30 is supplied to the developing roller 31 by rotation of its supply roller 30. The developer is frictionally electrified in positive polarity between the supply roller 30 and the developing roller 31. In the developer supplied to the developing roller 31, a layer thickness of the developer is regulated by the pressure contact rubber 42 of the layer thickness regulating blade 32. Consequently, a thin layer of the developer is carried on a surface of the developing roller 31.

In contrast, a surface of the photoconductive drum 26 is positively electrified uniformly by the electrification device 27 with rotation of its photoconductive drum 26. Then, an electrostatic latent image corresponding to an image to be formed on the sheet 3 is formed by irradiating its positively electrified surface of the photoconductive drum 26 with a laser beam from the scanner unit 12 (see FIG. 1).

When the electrostatic latent image formed on the surface of the photoconductive drum 26 is opposed to the developing roller 31 by rotation of the photoconductive drum 26, the positively electrified developer carried on the surface of the developing roller 31 is supplied to the electrostatic latent image (that is, the low electric potential portion exposed by a laser beam among the surface of the photoconductive drum 26 positively electrified uniformly). Consequently, the electrostatic latent image is imaged and transferred and a developer image is carried on the surface of the photoconductive drum 26. The developer image carried on the surface of the photoconductive drum 26 is transferred to the sheet 3 when the sheet 3 conveyed from the resister rollers 10 passes between the photoconductive drum 26 and the transfer roller 28.

(3-3) Fixing Part

The fixing part 14 is disposed at the back side of the developing unit 13 as shown in FIG. 1. The fixing part 14 comprises a heating roller 50, a pressurizing roller 51 brought into pressure contact with the heating roller 50, and a pair of conveying rollers 52 arranged in the back of their rollers.

The developer image transferred to the sheet 3 is fixed to the sheet 3 by heating and pressurizing from the heating roller 50 and the pressurizing roller 51 while the sheet 3 passes between the heating roller 50 and the pressurizing roller 51. The sheet 3 to which the developer image is fixed is conveyed to the sheet discharge part 6 by the pair of conveying rollers 52.

(4) Sheet Discharge Part

The sheet discharge part 6 comprises a sheet discharge path 53, a pair of sheet discharge rollers 54, and a sheet discharge tray 55. The sheet 3 conveyed from the fixing part 14 is conveyed to the sheet discharge path 53 and is discharged on the sheet discharge tray 55 by the sheet discharge rollers 54.

(Developing Unit)

Figure 3:
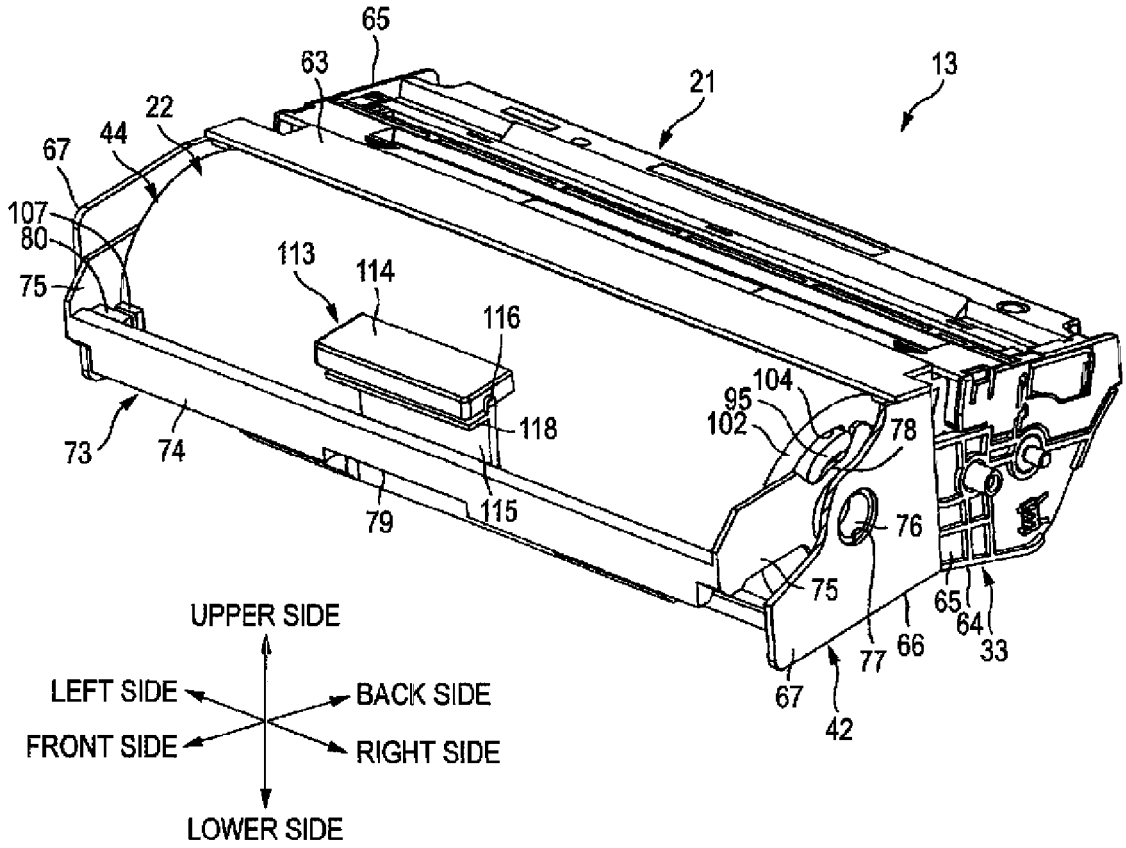
FIG. 3 is a schematic perspective view of the developing unit of FIG. 2 as viewed from a front right side of the developing unit.
Figure 4:
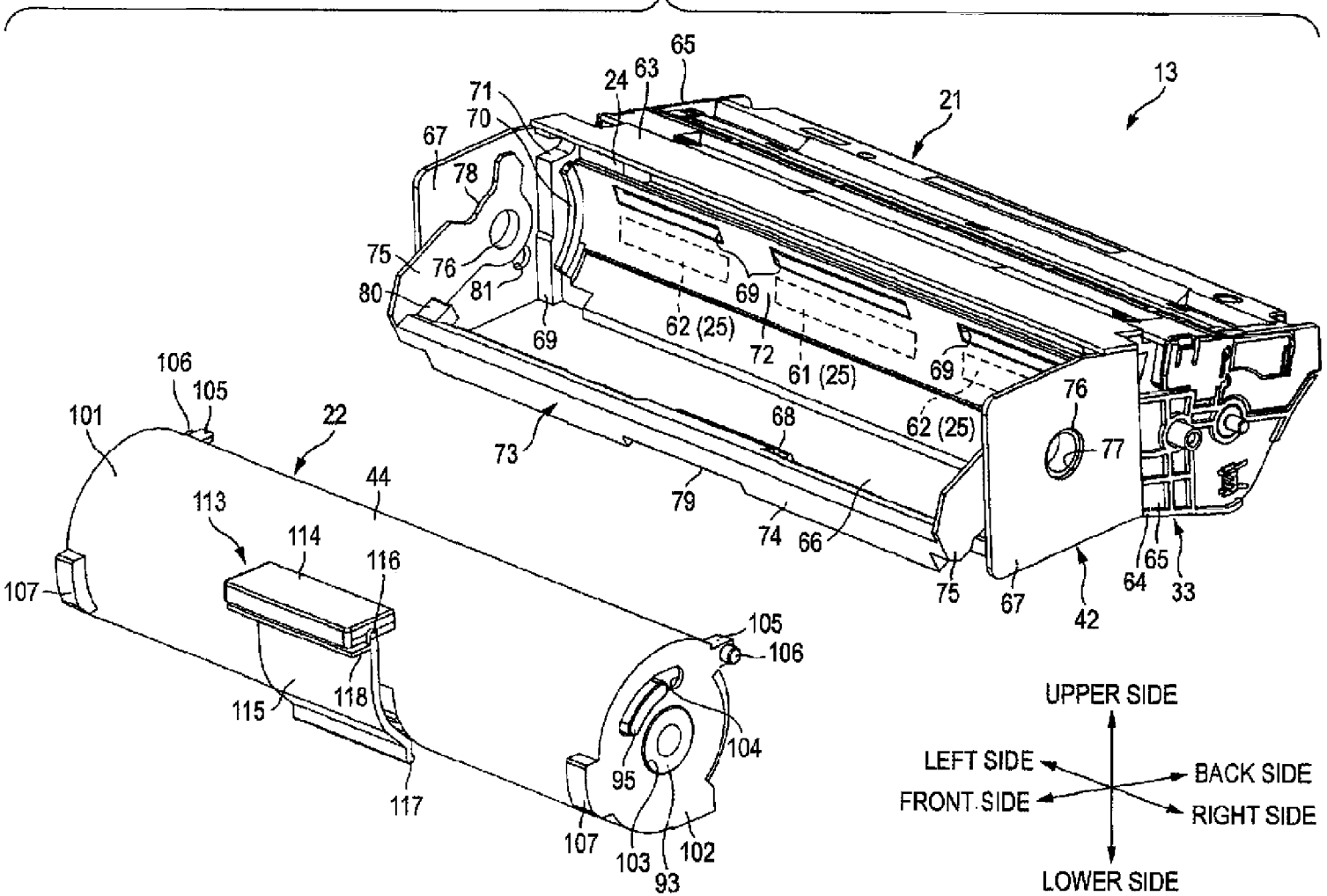
FIG. 4 is an exemplary perspective view, as viewed from the front right side of the developing unit of FIG. 3, showing the developing unit in a state in which the developer cartridge is detached from the process frame.
Figure 5:
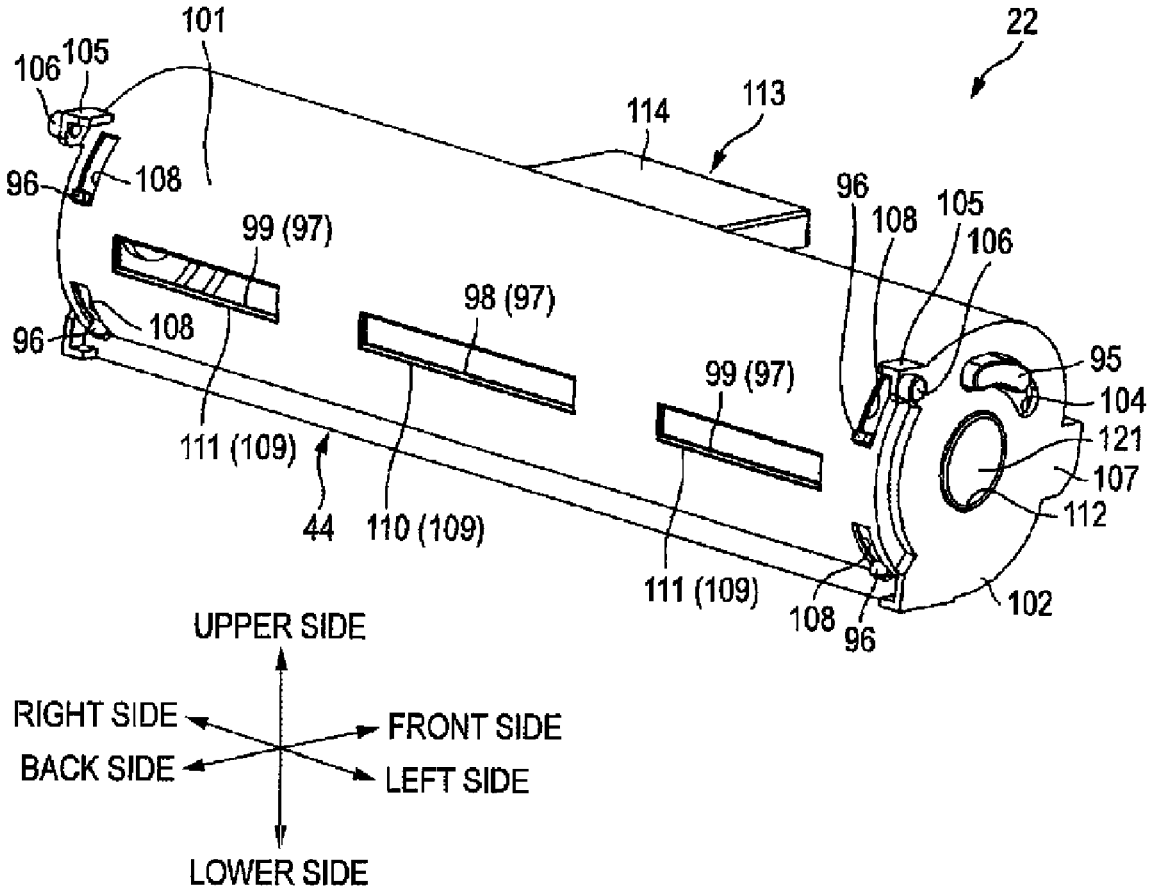
FIG. 5 is an exemplary perspective view of the developer cartridge of FIG. 4, as viewed from a back left side, in a state in which an inside cabinet is in an opened position.
Figure 6:
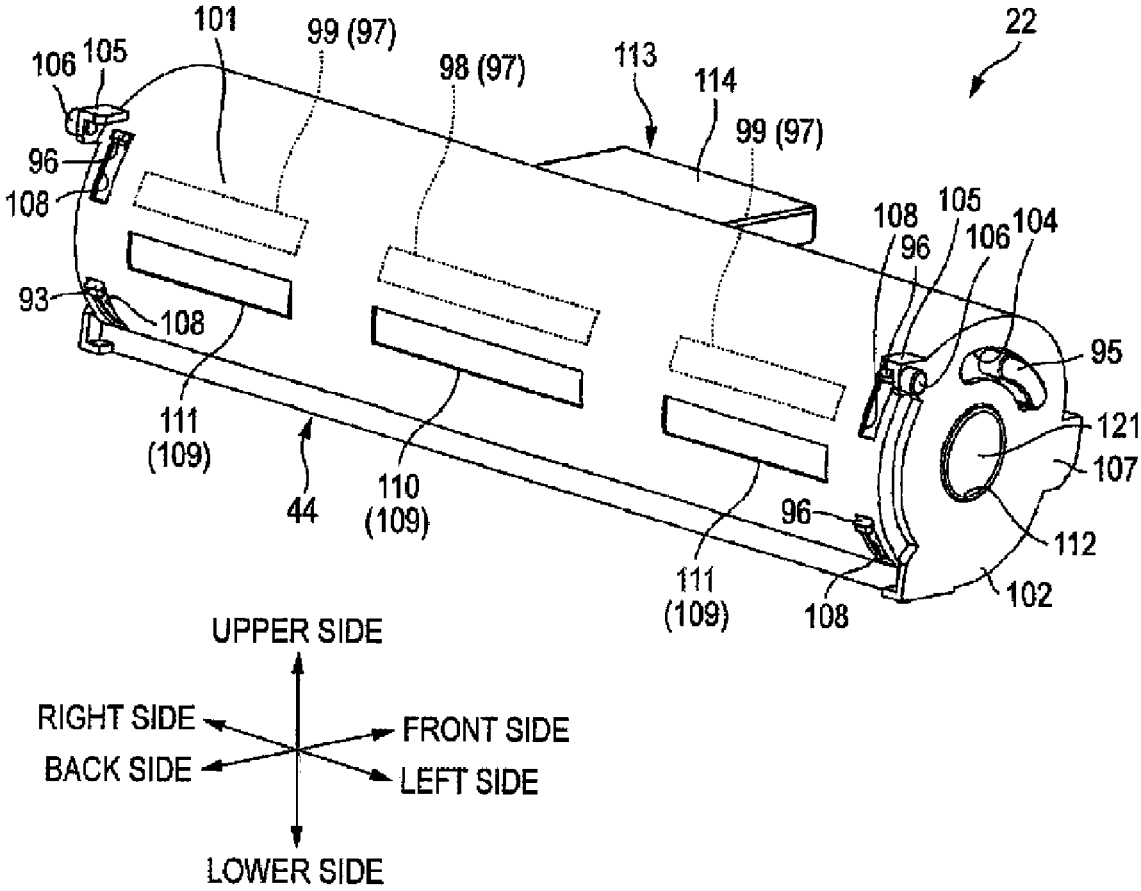
FIG. 6 is an exemplary perspective view of the developer cartridge of FIG. 4, as viewed from the back left side, in a state in which the inside cabinet is in a closed position.
Figure 7:
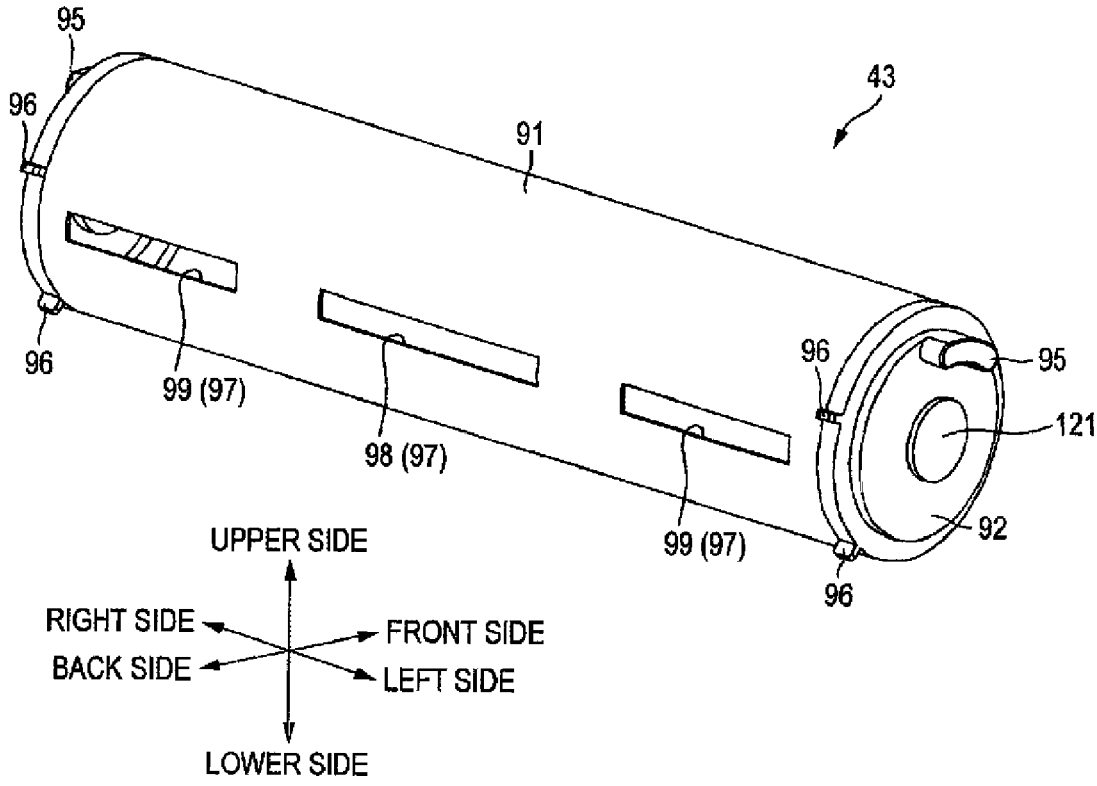
FIG. 7 is an exemplary perspective view, as viewed from a back left side, of the inside cabinet of the developer cartridge of FIG. 4.
Figure 8:
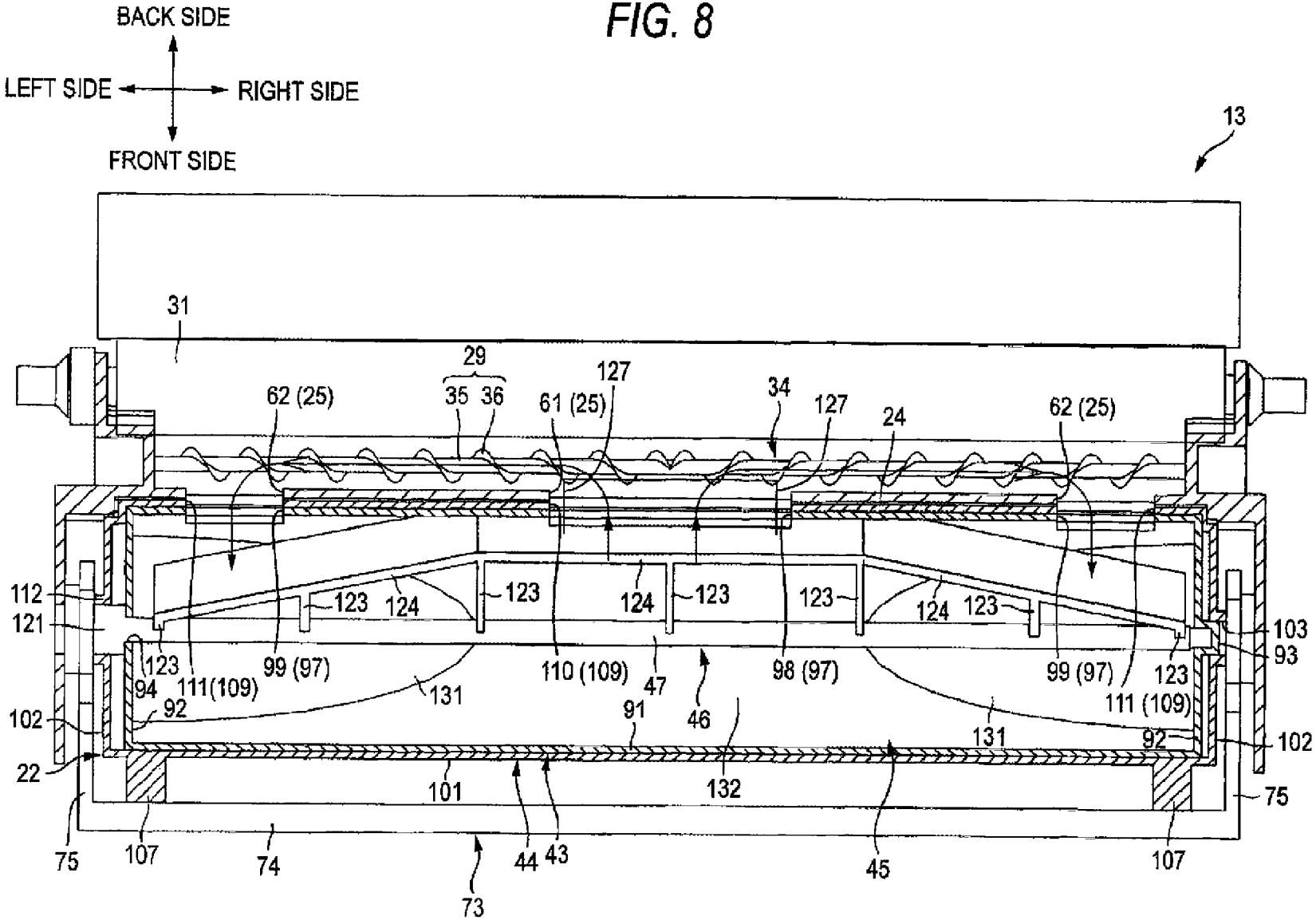
FIG. 8 is an exemplary plan sectional view of the developing unit of FIG. 3.

FIG. 3 is a perspective view viewed from the front right side of the developing unit 13 and shows a state of the developing unit 13 in which the developer cartridge 22 is attached to the process frame 21. FIG. 4 is a perspective view viewed from the front right side of the developing unit 13 and shows a state of the developing unit 13 in which the developer cartridge 22 is detached from the process frame 21. FIGS. 5 and 6 are perspective views viewed from the back left side of the developer cartridge 22. FIG. 7 is a perspective view viewed from the back left side of the inside cabinet 43 of the developer cartridge 22. FIG. 8 is a plan sectional view of the developing unit 13.

(1) Process Frame

The Process frame 21 integrally includes the bulkhead 24, the process part 33 at the back side of the bulkhead 24, and the cartridge attachment part 42 at the front side of the bulkhead 24 as described above.

(1-1) Bulkhead

The bulkhead 24 comprises a curved portion in the middle of the upper and lower directions, as shown in FIG. 2. The curved portion of the bulkhead 24 has a radius of curvature that matches an outer peripheral surface of the developer cartridge 22 as shown in FIG. 2.

The frame side openings 25 are formed in the curved portion of the bulkhead 24 at a spacing in the width direction as shown in FIG. 4.

The frame side opening 25 at the center is a frame side supply opening 61 for supplying developer from the inside of the developer cartridge 22 (i.e., developer accommodate chamber 45) to the inside of the process part 33 (i.e., the developing chamber 34). The frame side supply opening 61 has a substantially rectangular shape longer in a width direction (i.e., a left and right direction) than a width direction of the frame side openings 25 on either side of the frame side supply opening 61.

The frame side openings 25 on either side of the frame side supply opening 61 are frame side return openings 62 for returning developer from the inside of the process part 33 (i.e., from the developing chamber 34) to the inside of the developer cartridge 22 (i.e., inside the developer accommodate chamber 45).

(1-2) Process Part

The process part 33 integrally includes an upper wall 63 extending backward from the upper edge of the bulkhead 24, a bottom wall 64 extending backward from the lower edge of the bulkhead 24, and side walls 65 respectively extending backward from both edges of the width direction of the bulkhead 24. The relationship between the walls of the process part 33 and the bulkhead 24 is most easily seen in FIGS. 2 and 4.

The developer transport member 29 arranged in the process part 33 comprises an developer transport member shaft 35, and a screw 36 disposed around the developer transport member shaft 35 (see FIGS. 2 and 8). The developer transport member shaft 35 extends in the width direction and both ends of the developer transport member shaft 35 are rotatably supported by the side walls 65. The screws 36 are respectively disposed on both sides with respect to the center of the width direction in the developer transport member shaft 35 and have a substantially spiral shape for transporting developer from the center of the width direction to both outsides of the width direction as shown in FIG. 8.

(1-3) Cartridge Attachment Part

The cartridge attachment part 42 integrally comprises a bottom plate 66 forward extending from the lower edge of the bulkhead 24, and side plates 67 respectively forward extending from both edges of the width direction of the bulkhead 24 as shown in FIG. 4.

The bottom plate 66 is integrally formed continuously with the bottom wall 64 of the process part 33.

A lower side fixed part 68 slightly protruding to the front side is provided in the center of the width direction of the front edge as shown in FIGS. 2 and 4.

Each of the side plates 67 is integrally formed continuously with both the side walls 65 of the process part 33.

A shutter support part 69 is disposed on an inside surface of the width direction of the back end of each of the side plates 67 as shown in FIG. 4. Each of the shutter support parts 69 has a substantially rectangular shape extending in the upper and lower directions and extends inwardly from the inside surface of the width direction of both the side plates 67.

A shutter guide part 70 is disposed on an inside surface of the width direction of each of the shutter support parts 69. Each of the shutter guide parts 70 forms a protrusion stripe extending inwardly from the inside surface of the width direction of the shutter support part 69. Also, each of the shutter guide parts 70 has a substantially curved shape with substantially the same curvature as that of the curved portion of the bulkhead 24. Each of the shutter guide parts 70 is arranged in a position opposed to the curved portion of the bulkhead 24 at a slight spacing from the bulkhead 24 in the front and back directions.

An upper end surface of each of the shutter support parts 69 is arranged in a position slightly lower than the upper edge of each of the side plates 67. The upper end surface of each of the shutter support parts 69 forms an upper side fixed part 71.

Also, a shutter 72 for opening and closing the frame side openings 25 is disposed in the cartridge attachment part 42.

The shutter 72 has a substantially rectangular shape extending in the width direction and has a substantially curved shape with substantially the same curvature as that of the curved portion of the bulkhead 24. The shutter 72 is formed slightly shorter than the shutter guide parts 70 in the upper and lower directions. Also, three shutter opening parts 69, corresponding to each of the frame side openings 25, are provided in the shutter 72.

The shutter 72 is arranged in a position opposed to the curved portion of the bulkhead 24, and both ends of a width direction of the shutter 72 are slidably pinched between the bulkhead 24 and each of the shutter guide parts 70. Consequently, the shutter 72 can slide along each of the shutter guide parts 70 in the upper and lower directions between an opened position (see FIG. 2) in which the frame side openings 25 are opened and a closed position (see FIG. 4) in which the frame side openings 25 are closed. When the shutter 72 is in the opened position, the shutter opening parts 69 in a position corresponding respectively to the frame side openings 25 and each of the frame side openings 25 is opened. When the shutter 72 is in the closed position, the portions of the shutter 72 below the shutter opening parts 69 are in a position corresponding respectively to the frame side openings 25 and each of the frame side openings 25 is closed.

Also, a swing arm 73 is disposed in the cartridge attachment part 42 as shown in FIGS. 3 and 4. The swing arm 73 has a substantially U shape in the case of being viewed from the plane. The swing arm 73 integrally comprises a grasp bar 74 extending in the width direction, and arm side plates 75 extending backward from both ends of the width direction of the grasp bar 74.

A boss 76 protruding outward in the width direction is disposed at the back end of each of the arm side plates 75. Each of the bosses 76 is turnably supported by a circular hole 77 provided in the center of each of the side plates 67.

Also, a receiving recessed part 78 notched so as to be recessed to the lower side is provided in the upper side edge at the back end of each of the arm side plates 75.

A grasp part 79 recessed to the upper side is provided in the center of the width direction of the grasp bar 74. Also, backward extending press protrusion parts 80 with rectangular shapes in the case of being viewed from the rear are disposed in both ends of the width direction of the grasp bar 74.

Using the boss 76 of each of the arm side plates 75 as a fulcrum, the swing arm 73 swings between a pressing release position (see FIG. 4) in which the lower edge of each of the arm side plates 75 makes contact with the front edge of the bottom plate 66 and a pressing position (see FIGS. 2 and 3) in which the developer cartridge 22 is pressed from the front side if the developer cartridge 22 is received in the cartridge attachment part 42.

(2) Developer Cartridge

The developer cartridge 22 comprises the inside cabinet 43 for accommodating developer, and the outside cabinet 44 for receiving the inside cabinet 43 as described above.

(2-1) Inside Cabinet

The inside cabinet 43 integrally comprises a cylindrical inside peripheral wall 91 extending in the width direction, and circular plate-shaped inside side walls 92 for closing both ends of the width direction of the inside peripheral wall 91 as shown in FIG. 7.

A boss part 93 with a circular thick plate shape extending outward in the width direction is disposed in the center of the right inside side wall 92 as shown in FIG. 8.

A shaft through hole 94 through which an agitator shaft 47 described below is passed is provided in the center of the left inside side wall 92.

A slide protrusion 95 is disposed in an upper side portion of each of the inside sidewalls 92. The slide protrusion 95 has a substantially circular arc shape (circular arc shape with a center angle of about 45°) in the case of being viewed from the side along an outer peripheral surface of the inside side wall 92, and is disposed so as to protrude from the inside side wall 92 to the outside of the width direction.

Also, a pair of pinch protrusions 96 radially protruding from a peripheral end surface are disposed in a back side portion of each of the inside side walls 92. The pair of pinch protrusions 96 are arranged at a spacing (spacing corresponding to a circumferential length of the shutter 72) in a circumferential direction mutually in the peripheral end surface of each of the inside side walls 92.

In the inside peripheral wall 91, three inside passage openings 97 are formed at a spacing in the width direction in a portion of the inside peripheral wall 91 surrounded by a rectangle with the corners of the pair of pinch protrusions 96 (i.e., there are four pinch protrusions 96) arranged in both sides of the width direction.

Each of the inside passage openings 97 has a substantially rectangular shape elongated in the width direction.

The inside passage opening 97 of the center is an inside supply opening 98 as one example of a supply opening for supplying developer from the inside of the developer cartridge 22 (i.e., the developer accommodate chamber 45) to the inside of the process part 33 (i.e., the developing chamber 34).

The inside passage openings 97 on either side of the inside supply opening 98 are inside return openings 99 for returning developer from the inside of the process part 33 (i.e., the developing chamber 34) to the inside of the developer cartridge 22 (i.e., the developer accommodate chamber 45).

(2-2) Outside Cabinet

The outside cabinet 44 is formed slightly larger than the inside cabinet 43 in the width and radial directions in order that the outside cabinet 44 may turnably receive the inside cabinet 43. The outside cabinet 44 integrally comprises an outside peripheral wall 101 with substantially a cylindrical shape extending in the width direction, and circular plate-shaped outside side walls 102 for closing both ends of the width direction of the outside peripheral wall 101 as shown in FIG. 6.

A circular boss hole 103 for receiving the boss part 93 is provided in the right outside side wall 102 as shown in FIG. 8.

A cylindrical shaft receiving part 112 for receiving the end of the agitator shaft 47 protruding from the shaft through hole 94 of the left inside side wall 92 to the outside of the width direction is provided in the left outside side wall 102.

Also, a slide hole 104 into which the slide protrusion 95 is inserted is provided in each of the outside side walls 102. The slide hole 104 has a circular arc shape (e.g., a circular arc shape with a center angle of about 90°) with a circumferential length longer than that of the slide protrusion 95 in the case of being viewed from the side, and extends between an upper front side and an upper back side of the boss hole 103.

Also, a backward protruding upper side part 105 to be fixed is formed on a peripheral end surface of each of the outside side walls 102. A positioning boss 106 outward protruding in the width direction is disposed in the back end of each of the upper side parts 105 to be fixed.

Also, a forward extending pressed part 107 is disposed on the peripheral end surface of each of the outside side walls 102 as shown in FIG. 4. Each of the pressed parts 107 has a substantially rectangular shape in the case of being viewed from the front and substantially a circular arc shape in the case of being viewed from the side.

Four elongated holes 108 into which the pairs of pinch protrusions 96 (i.e., there are four pinch protrusions 96) are respectively inserted are provided at both ends of the width direction in the outside peripheral wall 101 as shown in FIG. 6. Each of the elongated holes 108 has a substantially rectangular shape extending in the upper and lower directions when viewed from the rear and has a length corresponding to a swing range between the opened position and the closed position of the shutter 72.

Also, in the outside peripheral wall 101, three outside passage openings 109 are formed at a spacing in the width direction in a portion of the outside peripheral wall 101 surrounded by a rectangle with corners at the four elongated holes 108.

Each of the outside passage openings 109 has a substantially rectangular shape elongated in the width direction.

The outside passage opening 109 of the center is an outside supply opening 110 for supplying developer from the inside of the developer cartridge 22 (i.e., the developer accommodate chamber 45) to the inside of the process part 33 (i.e., the developing chamber 34).

The outside passage openings 109 of both sides of the outside supply opening 110 are outside return openings 111 for returning developer from the inside of the process part 33 (i.e., the developing chamber 34) to the inside of the developer cartridge 22 (i.e., the developer accommodate chamber 45).

The outside supply opening 110 corresponds to the frame side supply opening 61 and is located in a position opposite to the frame side supply opening 61, and each of the outside return openings 111 corresponds to respective frame side return openings 62 in a state in which the developer cartridge 22 is attached to the process frame 21 as shown in FIG. 2.

Also, in the front side of the outside peripheral wall 101, a grip part 113 is disposed in the center of the width direction as shown in FIG. 4.

The grip part 113 comprises an upper grasp plate 114 with a substantially rectangular shape protruding forward from the outside peripheral wall 101, and a locking arm 115 with a substantially J shape in the case of being viewed from the side downward extending from the upper grasp plate 114. The upper end of the locking arm 115 is swingably supported by a support shaft 116 disposed in the upper grasp plate 114. A locking claw 117 for locking in the lower side fixed part 68 is disposed in the lower end of the locking arm 115. A lower grasp plate 118 with a substantially rectangular shape protruding forward is disposed in the vicinity of the upper end of the locking arm 115. The lower grasp plate 118 is arranged so as to extend in a space parallel with the upper grasp plate 114.

A compression spring (not shown) for urging the upper and lower grasp plates in a direction of separation is interposed between the upper grasp plate 114 and the lower grasp plate 118.

(2-3) Relative Arrangement of Inside Cabinet and Outside Cabinet

The inside cabinet 43 is turnably received inside the outside cabinet 44.

More specifically, an outer peripheral surface of the inside peripheral wall 91 is inward fitted slidably in a circumferential direction with respect to an inner peripheral surface of the outside peripheral wall 101. Also, outer peripheral surfaces of both the inside side walls 92 are inward fitted slidably in a circumferential direction with respect to inner peripheral surfaces of both the outside side walls 102. The boss part 93 is turnably supported in the boss hole 103 as shown in FIGS. 5 and 6. The end of the agitator shaft 47 is turnably supported in the shaft receiving part 112. The slide protrusion 95 is inserted into the slide hole 104. Each of the pinch protrusions 96 is inserted into each of the elongated holes 108, and each of the pinch protrusions 96 is protruded from each of the elongated holes 108 to the outside of a radial direction.

The inside cabinet 43 permits relative turns using the end of the agitator shaft 47 and the boss part 93 as a fulcrum between a closed position (see FIG. 6) in which the inside passage openings 97 are not opposed to the outside passage openings 109 and an opened position (see FIG. 5) in which the inside passage openings 97 are opposed to the outside passage openings 109 with respect to the outside cabinet 44.

When the inside cabinet 43 is in the closed position, each of the slide protrusions 95 is arranged in the front end of each of the slide holes 104 as shown in FIG. 6. Also, each of the pinch protrusions 96 is arranged in the upper end of each of the elongated holes 108. The inside passage openings 97 are arranged in a position above the outside passage openings 109, and the outside passage openings 109 are closed by the inside peripheral wall 91 of the inside cabinet 43.

The inside cabinet 43 is relatively turned in a direction (lower side) in which the inside passage openings 97 move toward the outside passage openings 109 with respect to the outside cabinet 44 using the end of the agitator shaft 47 and the boss part 93 as a fulcrum. Then, each of the slide protrusions 95 slides each of the slide holes 104 from the front end toward the back end. Also, each of the pinch protrusions 96 slides each of the elongated holes 108 from the upper end toward the lower end.

When each of the slide protrusions 95 abuts on the back edge of each of the slide holes 104 and each of the pinch protrusions 96 abuts on the lower edge of each of the elongated holes 108, the inside cabinet 43 is arranged in the opened position as shown in FIG. 5.

When the inside cabinet 43 is in the opened position, each of the slide protrusions 95 is arranged in the back end of each of the slide holes 104. Also, each of the pinch protrusions 96 is arranged in the lower end of each of the elongated holes 108. Then, the inside passage openings 97 are opposed to the outside passage openings 109 and these passage openings communicate with each other and are opened.

In addition, when the inside cabinet 43 is returned to the closed position, the inside cabinet 43 is relatively turned in a direction in which the inside passage openings 97 rise from the outside passage openings 109 with respect to the outside cabinet 44 using the end of the agitator shaft 47 and the boss part 93 as the fulcrum.

(3) Attachment and Detachment of Developer Cartridge to and from Process Frame (3-1) Attachment of Developer Cartridge to Process Frame Referring to FIG. 4, when the developer cartridge 22 is attached to the process frame 21, the upper grasp plate 114 and the lower grasp plate 118 of the grip part 113 are pinched in a direction in which the grasp plates move near to each other. Then, the developer cartridge 22 is attached to the cartridge attachment part 42 of the process frame 21. The inside cabinet 43 of the developer cartridge 22 is arranged in the closed position. Also, the shutter 72 of the cartridge attachment part 42 is arranged in the closed position. The swing arm 73 is arranged in a pressing release position.

When the developer cartridge 22 is attached to the cartridge attachment part 42, each of the positioning bosses 106 is placed on each of the upper side fixed parts 71 and a pair of the pinch protrusions 96 (see FIGS. 5 and 6) on both sides in the width direction respectively pinch the upper edge and the lower edge on both ends in the width direction of the shutter 72 and each of the slide protrusions 95 is fitted into each of the receiving recessed parts 78.

Thereafter, when the pinch of the grip part 113 is released, the locking claw 117 is locked in the lower side fixed part 68 as shown in FIG. 2.

The outside cabinet 44 is fixed to the cartridge attachment part 42 since the positioning bosses 106 are placed to the upper side fixed parts 71 (see FIG. 4) and the locking claw 117 is locked to the lower side fixed part 68.

The swing arm 73 is swung from the pressing release position to a pressing position. Each of the press protrusion parts 80 presses each of the pressed parts 107 toward the back side as shown in FIGS. 2 and 3. Consequently, the developer cartridge 22 is pressed toward the process part 33.

Also, when the swing arm 73 is swung from the pressing release position to the pressing position, with swing of each of the arm side plates 75, each of the slide protrusions 95 fitted into each of the receiving recessed parts 78 slides each of the slide holes 104 to the back side and is arranged in the back end of each of the slide holes 104. Further, with the shutter 72 pinched, a pair of the pinch protrusions 96 on both sides in the width direction slides each of the elongated holes 108 to the lower side and is arranged in the lower end of each of the elongated holes 108 (see FIG. 5).

Consequently, the inside cabinet 43 is arranged in the opened position as shown in FIG. 2. Then, the inside passage openings 97 are opposed to the outside passage openings 109 and these passage openings are communicated and opened and thereby, the cartridge side opening 49 is formed.

At the time of forming an image, by an agitating blade 48 of the agitator 46 described below, developer of the inside of the developer accommodate chamber 45 (i.e., in the inside cabinet 43) is transported to the cartridge side opening 49 made of the inside supply opening 98 and the outside supply opening 110 as shown by arrows in FIG. 8 and is discharged from the cartridge side opening 49. The developer discharged from the cartridge side opening 49 is supplied to the inside of the developing chamber 34 (i.e., to the process part 33) through the frame side supply opening 61.

By the developer transport member 29, the developer supplied from the frame side supply opening 61 to the inside of the process part 33 is transported from the center of the width direction to both sides of the width direction and is supplied to the supply roller 30 on the way. The developer supplied to the supply roller 30 is supplied to the developing roller 31 as described above. The developer which has not been supplied to the supply roller 30 is transported to the frame side return openings 62 and passes through the cartridge side opening 49 made of the inside return openings 99 and the outside return openings 111 and is returned to the inside of the developer accommodate chamber 45. Consequently, the developer is circulated between the developing chamber 34 and the developer accommodate chamber 45.

(3-2) Detachment of Developer Cartridge from the Process Frame

When the developer cartridge 22 is detached from the process frame 21, the swing arm 73 is first swung from the pressing position to the pressing release position. Then, each of the press protrusion parts 80 is separated from each of the pressed part 107 and a press of the developer cartridge 22 on the process part 33 is released.

Also, when the swing arm 73 is swung from the pressing position to the pressing release position, with swing of each of the arm side plates 75, each of the slide protrusions 95 fitted into each of the receiving recessed parts 78 slides each of the slide holes 104 to the front side and is arranged in the front end of each of the slide holes 104 as shown in FIG. 6. Further, with the shutter 72 pinched, a pair of the pinch protrusions 96 on both sides in the width direction slides each of the elongated holes 108 to the upper side and is arranged in the upper end of each of the elongated holes 108.

Consequently, the inside cabinet 43 is arranged in the closed position, and the inside peripheral wall 91 of the inside cabinet 43 is opposed to the outside passage openings 109, and the outside passage openings 109 are closed. Also, the shutter 72 is arranged in the closed position, and the frame side openings 25 are opposed to the shutter 72 and are closed.

When the upper grasp plate 114 and the lower grasp plate 118 of the grip part 113 are pinched in a direction in which the grasp plates move near to each other, the locking mechanism of the locking claw 117 to the lower side fixed part 68 is released, so that when the developer cartridge 22 is pulled from the cartridge attachment part 42 to the front side, the developer cartridge 22 is detached from the process frame 21 as shown in FIG. 4.

(4) Agitator

Figure 9:
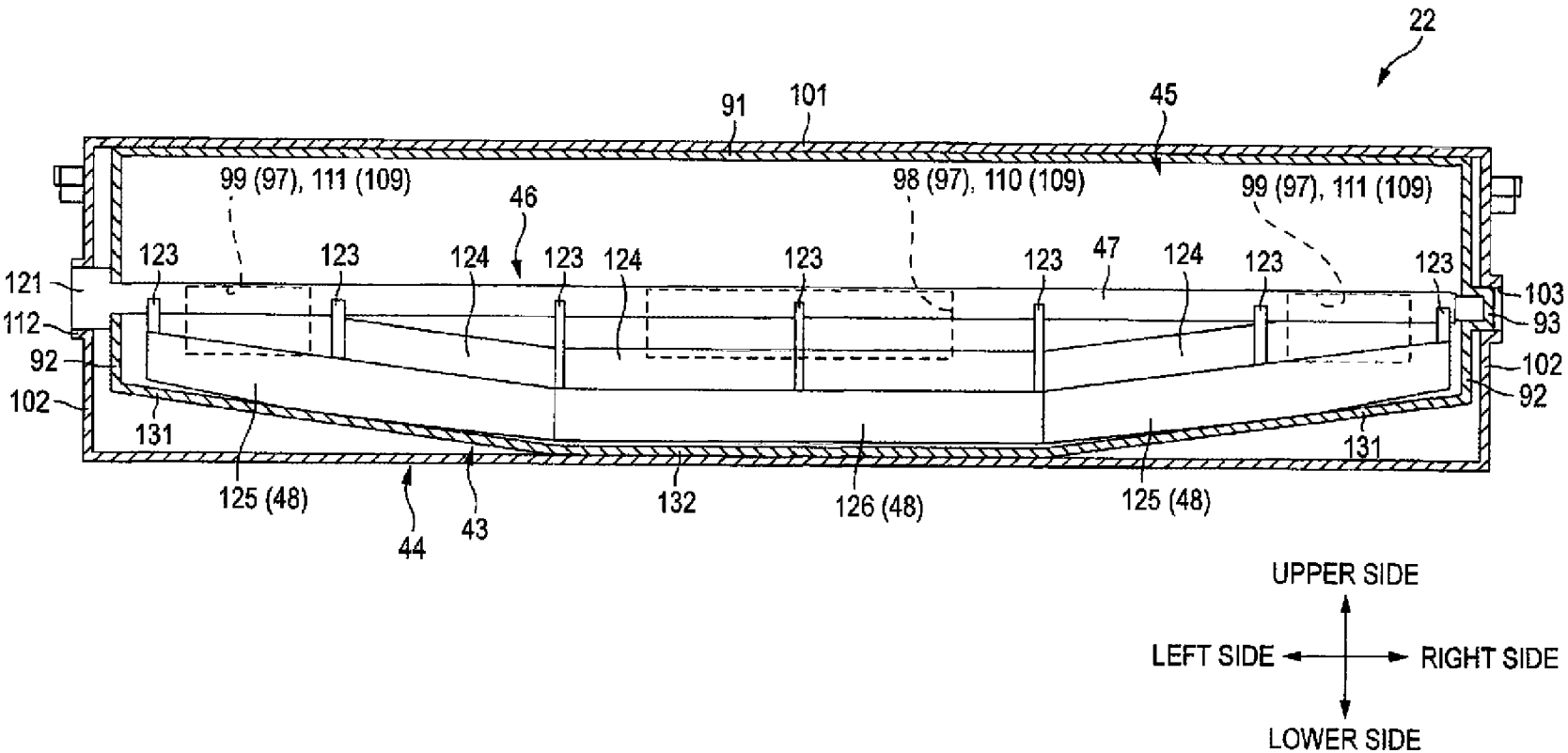
FIG. 9 is an exemplary front sectional view of the developer cartridge of FIG. 4.

FIG. 9 is a front sectional view (a sectional view cut by a vertical plane along the width direction) of the developer cartridge 22.

The agitator 46 is disposed inside the inside cabinet 43 (i.e., the developer accommodate chamber 45) as described above. The agitator 46 comprises the agitator shaft 47 as one example of a rotational shaft, and agitating blades 48 supported by the agitator shaft 47.

The right end of the agitator shaft 47 is rotatably held in the boss part 93 of the inside cabinet 43 as shown in FIGS. 8 and 9.

Also, the agitator shaft 47 extends through the shaft through hole 94 of the inside cabinet 43. An agitator coupling gear 121 to which driving force from a motor (not shown) is inputted is coupled to the left end of the agitator shaft 47. Then, the agitator coupling gear 121 is rotatably held in the shaft receiving part 112 of the outside cabinet 44.

The proximal ends of plural support bars 123 are coupled to the agitator shaft 47 inside the developer accommodate chamber 45. These support bars 123 are arranged at equal spacing in the width direction along the agitator shaft 47 on the same plane. The support bars 123 coupled to the center of the agitator shaft 47 (in this aspect, three support bars 123, and hereinafter called "center support bars 123") have the same length in a direction orthogonal to the agitator shaft 47, and are formed longer than those of the support bars 123 coupled to both ends of the agitator shaft 47. In the support bars 123 coupled to both ends of the agitator shaft 47 (in this aspect, two support bars 123 on each side, and hereinafter called "end support bars 123"), a length of a direction orthogonal to the agitator shaft 47 becomes shorter as the support bar is nearer to the end of the agitator shaft 47.

A joint bar 124 is installed between the tops of the support bars 123 adjacent in the width direction. The joint bar 124 extends parallel to the agitator shaft 47 in the portion installed between the tops of the center support bars 123, and is inclined with respect to the agitator shaft 47 in the portion installed between the tops of the end support bars 123 in both sides of the center support bars 123. In other words, as the joint bar 124 moves away from a center portion in the width direction of the agitator shaft 47, the distance between the joint bar 124 and the agitator shaft 47 decreases.

The agitating blades 48 comprises first agitating blades 125 supported by the portion of the joint bar 124 which is inclined with respect to the agitator shaft 47, and a second agitating blade 126 supported by the portion of the joint bar 124 extending parallel to the agitator shaft 47.

Each of the first agitating blades 125 is made of a flexible film such as a resin film. Each of the first agitating blades 125 has a substantially parallelogram shape in which the top edge (i.e., the edge of the free end side) of the first agitating blade 125 extends parallel to the joint bar 124 (i.e., is inclined in a direction along the agitator shaft 47) as shown in FIG. 9. Consequently, a length from the agitator shaft 47 to the top edge of the first agitating blade 125 becomes longer as the top edge is nearer to the second agitating blade 126. A length from the agitator shaft 47 to the top in the edge of the side of the first agitating blade 125 near to the second agitating blade 126 is equalized to a length from the agitator shaft 47 to the top in both edges of the width direction of the second agitating blade 126.

Each of the first agitating blades 125 passes across a respective inside return opening 99 during rotation. By forming each of the first agitating blades 125 in the parallelogram shape, in the portion of the first agitating blade 125 passing across the inside return opening 99, the length from the agitator shaft 47 to the top edge becomes shorter than a linear distance between the agitator shaft 47 and the respective inside return opening 99. Therefore, the top edge of each of the first agitating blades 125 does not make contact with an inner peripheral surface of the inside peripheral wall 91 of the inside cabinet 43 at the periphery of the inside return opening 99.

The second agitating blade 126 is made of a flexible film such as a resin film. The second agitating blade 126 has a substantially rectangular shape in which the top edge (i.e., the edge of the free end side) of the second agitating blade 126 extends parallel to the agitator shaft 47. The second agitating blade 126 is formed so that a width in the width direction along the agitator shaft 47 is longer than a width in the width direction of the inside supply opening 98. Also, the second agitating blade 126 is formed so that a length from the agitator shaft 47 to the top edge is longer than a linear distance between the agitator shaft 47 and the inside supply opening 98. Consequently, the second agitating blade 126 rotates while sliding against the inner peripheral surface of the inside peripheral wall 91 of the inside cabinet 43, and passes over the inside supply opening 98 during the rotation.

As shown in FIG. 8, two notches 127 are provided in the second agitating blade 126 in the portion passing across the inside supply opening 98 at the time of the rotation. These notches 127 linearly extend from the top edge toward the joint bar 124 at a spacing shorter than the width in the width direction of the inside supply opening 98 mutually.

(5) Bottom Surface of Developer Accommodate Chamber

A bottom surface of the developer accommodate chamber 45 has first bottom surface portions 131 opposed to the first agitating blades 125, and a second bottom surface portion 132 opposed to the second agitating blade 126 as shown in FIGS. 8 and 9.

As shown in FIG. 9, the first bottom surface portion 131 has an inclined sectional shape which is higher at the outside in the width direction and is lower at the inside in the width direction. Consequently, the first bottom surface portions 131 are provided in a position nearer to the agitator shaft 47 than the second bottom surface portion, and the first agitating blade 125 rotates while sliding across the first bottom surface portion 131.

The second bottom surface portion 132 has a sectional shape parallel to the agitator shaft 47 as shown in FIG. 9.

As described above, each of the first agitating blades 125 and the second agitating blade 126 are supported by the agitator shaft 47 extending through the inside of the developer accommodate chamber 45. The first agitating blades 125 are arranged in a position opposed to a respective inside return opening 99 for returning developer to the inside of the developer accommodate chamber 45. Also, in the first agitating blade 125, a length from the agitator shaft 47 to the top edge becomes shorter than a linear distance between the agitator shaft 47 and the inside return opening 99 in the portion passing across the inside return opening 99 at the time of rotation. As a result, the first agitating blade 125 does not make contact with developer in the vicinity of the inside return opening 99, and a force of extruding from the inside return opening 99 to the outside is not directly applied to the developer. In contrast, the second agitating blade 126 is arranged in a position opposed to the inside supply opening 98 for supplying developer from the inside of the developer accommodate chamber 45 to the outside. The second agitating blade 126 is formed so that a length from the agitator shaft 47 to the top edge is longer than a linear distance between the agitator shaft 47 and the inside supply opening 98. As a result, the second agitating blade 126 can better extrude the developer from the inside supply opening 98 toward the outside. That is, a flow of the developer returned from the inside return opening 99 to the inside of the developer accommodate chamber 45 is not blocked by the first agitating blade 125 and the developer of the inside of the developer accommodate chamber 45 can be extruded better from the inside supply opening 98 toward the outside by the second agitating blade 126. As a result, smooth circulation of the developer between the developer accommodate chamber 45 and the outside can be ensured.

The inside of the developing chamber 34 is provided with the developer transport member 29 for transporting developer in a direction along the agitator shaft 47, so that the developer supplied from the inside supply opening 98 to the inside of the developing chamber 34 can well be transported in a width direction. As a result, smoother circulation of the developer between the developer accommodate chamber 45 and the developing chamber 34 can be ensured.

Also, in the second agitating blade 126, two notches 127 are provided in the portion passing across the inside supply opening 98 at the time of the rotation. These notches 127 linearly extend from the top edge toward the joint bar 124 at a spacing shorter than a width in the width direction of the inside supply opening 98 mutually. As a result, as shown in FIGS. 2 and 8, the portion between the notches 127 of both ends of the width direction protrudes from the inside supply opening 98 to the outside when the second agitating blade 126 passes across the inside supply opening 98. Therefore, the developer on the inside of the developer accommodate chamber 45 is bumped out of the inside supply opening 98. As a result, the developer can be supplied better from the inside of the developer accommodate chamber 45 to the outside.

Also, in a bottom surface of the developer accommodate chamber 45, the first bottom surface portions 131 opposed to the first agitating blades 125 are provided in a position nearer to the agitator shaft 47 than the second bottom surface portion 132 opposed to the second agitating blade 126. As a result, developer on the first bottom surface portions 131 can be agitated by the first agitating blades 125 even when a length of the portion of the first agitating blade 125 passing across the inside return opening 99 is shorter than a length of the second agitating blade 126. As a result, the developer can be prevented from being retained on the first bottom surface portions 131.

Further, the first agitating blades 125 make contact with the first bottom surface portions 131 and rotate while sliding against the first bottom surface portions 131, so that the developer on the first bottom surface portions 131 can be agitated more effectively.

Furthermore, the first bottom surface portions 131 are inclined so as to lower as the first bottom surface portions 131 become near to the second bottom surface portion 132. As a result, using the inclination of the first bottom surface portions 131, developer on the first bottom surface portions 131 can be supplied onto the second bottom surface portion 132. As a result of that, retention of the developer on the first bottom surface portions 131 can be more easily prevented.

Also, in the first agitating blades 125, a length from the agitator shaft 47 to the top edge becomes longer as the first agitating blades 125 become nearer to the second agitating blade 126. As a result, in the whole width of a width direction of each of the first agitating blades 125, the top edge of the first agitating blade 125 is not largely separated from the respective first bottom surface portion 131. Therefore, developer on the respective first bottom surface portion 131 can be agitated over the whole width in the width direction by the respective first agitating blade 125. As a result, the developer can be more easily prevented from being retained on the respective first bottom surface portion 131.

Further, a length of the first agitating blades 125 from the agitator shaft 47 to the top of the edge of the sides nearer to the second agitating blade 126 is equal to a length of the second agitating blade 126 from the agitator shaft 47 to the top of the edge of the side nearer to the first agitating blades 125. As a result, developer can be prevented from being retained at the boundary between the first bottom surface portions 131 and the second bottom surface portion 132.

Also, the inside supply opening 98 is provided in the center in a width direction of the inside cabinet 43. The inside return openings 99 are respectively provided on both sides in the width direction with respect to the inside supply opening 98. As a result, developer is supplied from the inside of the developer accommodate chamber 45 to the outside through the inside supply opening 98 of the center in the width direction and is returned from the inside return openings 99 on both sides to the inside of the developer accommodate chamber 45. Consequently, in the outside and the inside of the developer accommodate chamber 45, the developer can be replaced in the width direction and retention of the developer in the width direction can be prevented.

MODIFIED EXAMPLES

(1) First Modified Example

Figure 10:
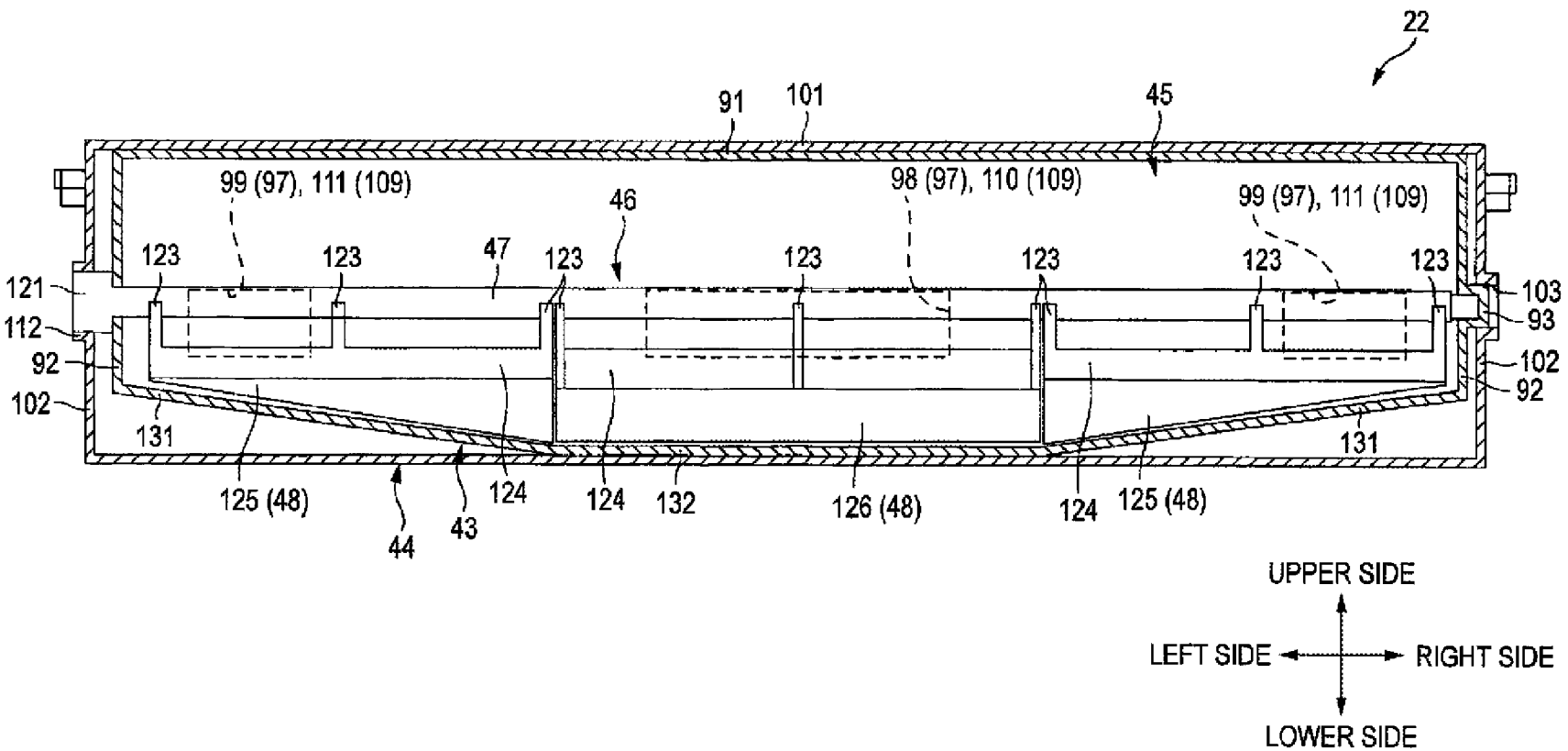
FIG. 10 is an exemplary front sectional view of the developer cartridge of FIG. 9 showing a first modified example of an agitator according to an aspect of the present invention.

FIG. 10 is a front sectional view of the developer cartridge 22 showing another configuration of the agitator 46. In FIG. 10, the same reference numerals as each part are assigned to the portions corresponding to each part shown in FIG. 9. Accordingly, only the differences from the agitator 46 shown in FIG. 9 will hereinafter be described.

In an agitator 46 shown in FIG. 10, each of the end support bars 123 is formed so that a length in a direction orthogonal to an agitator shaft 47 is the same and this length is shorter than a length of the center support bars 123 in the direction orthogonal to the agitator shaft 47.

Each of the first agitating blades 125 has a substantially triangular shape in which the top edge is inclined in a width direction. Consequently, a length from the agitator shaft 47 to the top edge of each of the first agitating blades 125 becomes longer as the top edge becomes nearer to the second agitating blade 126. A length from the agitator shaft 47 to the top of the edge of the first agitating blade 125 at the side near to the second agitating blade 126 is equalized to a length from the agitator shaft 47 to the top of the second agitating blade 126.

The agitator 46 shown in FIG. 10 also has an action similar to that of the agitator 46 shown in FIG. 9.

(2) Second Modified Example

Figure 11:
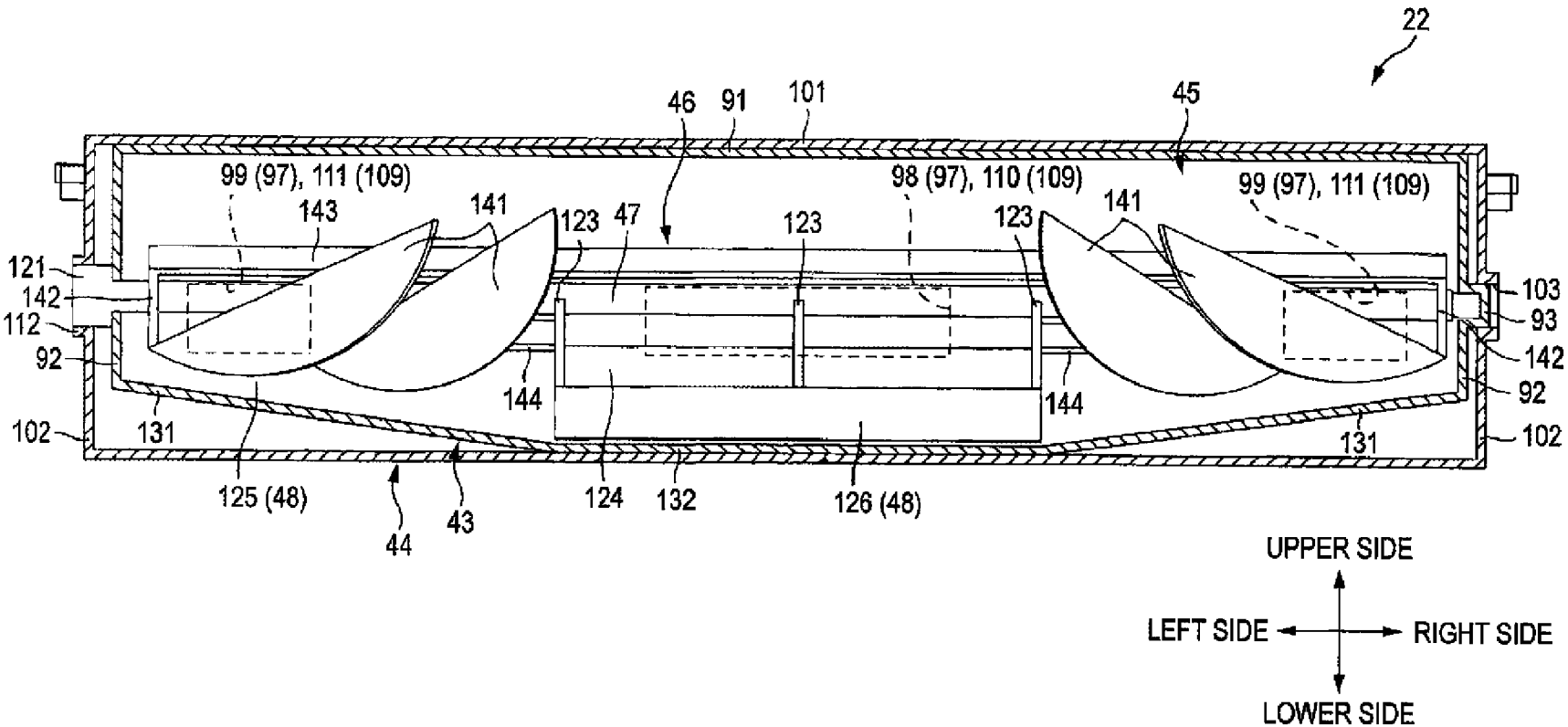
FIG. 11 is an exemplary front sectional view of the developer cartridge of FIG. 10 showing a second modified example of an agitator according to an aspect of the present invention.

FIG. 11 is a front sectional view of the developer cartridge 22 showing another configuration of the agitator 46. In FIG. 11, the same reference numerals as each part are assigned to the portions corresponding to each part shown in FIG. 9. Accordingly, only the differences from the agitator 46 shown in FIG. 9 will hereinafter be described.

An agitator 46 shown in FIG. 11 comprises four first agitating blades 141 instead of the two first agitating blades 125 shown in FIG. 9. Also, the end support bars 123 shown in FIG. 9 are omitted and two support bars 142 extending in a direction orthogonal to an agitator shaft 47 are fixed on either end of the agitator shaft 47. A first joint bar 143 extending in a width direction is attached to one end of each of the two support bars 142, connecting the one ends of the two support bars 142 together. A second joint bar 144 extending in the width direction is provided between the center support bar 123 and the other end of each of the support bars 142.

Two of the four first agitating blades 141 are arranged on one side of the second agitating blade 126, and the remaining two of the four first agitating blades 141 are arranged on the other side of the second agitating blade 126. In other words, two first agitating blades 141 are arranged on either side of the second agitating blade 126. Each of the first agitating blades 141 is fixed to the first joint bar 143 and the second joint bar 144 astride the first joint bar 143 and the second joint bar 144. Each of the first agitating blades 141 is disposed so as to intersect with respect to the agitator shaft 47 in the case of being viewed in a direction orthogonal to the agitator shaft 47 so that the inside end in the width direction is located relative to the back side and the outside end in the width direction is located relative to the front side in a state opposed to the first bottom surface portion 131. Also, each of the first agitating blades 141 is disposed in a state slightly inclined to the inside in the width direction.

According to this example, in the first agitating blades 141, one end of the side far from an inside supply opening 98 precedes and the other end of the side near to the inside supply opening 98 follows at the time of rotation of the agitator 46. As a result, at the time of rotation of the first agitating blades 141, force in a direction towards the side of the inside supply opening 98 can be applied to developer from the first agitating blades 141 and, by this force, the developer can be moved to the side of the inside supply opening 98. Consequently, a flow of the developer from inside return opening 99 to the inside supply opening 98 can be formed inside a developer accommodate chamber 45. Thus, a smoother circulation of the developer between the developer accommodate chamber 45 and its outside can be achieved.

(3) Additional Examples

In the above-described aspects, the photoconductive drum 26, the electrification device 27, the transfer roller 28, the developer transport member 29, the supply roller 30, the developing roller 31 and the layer thickness regulating blade 32 are integrally held in the developing unit 13. However, the developing unit 13 may comprise a drum cartridge which is configured attachably to and detachably from the body casing 2 and which integrally holds the photoconductive drum 26, the electrification device 27 and the transfer roller 28, and a development cartridge which is configured attachably to and detachably from the drum cartridge and which integrally holds the developer transport member 29, the supply roller 30, the developing roller 31 and the layer thickness regulating blade 32.

Further, the photoconductive drum 26, the electrification device 27 and the transfer roller 28 may be mounted inside the body casing 2 rather than in the form of the drum cartridge.

Still further, a sectional shape of the first bottom surface portions 131 may be formed flush with a sectional shape of the second bottom surface portion 132 and the first bottom surface portions 131 may be formed parallel to the agitator shaft 47. Also, the first bottom surface portions 131 may be arranged in a position nearer to the agitator shaft 47 than the second bottom surface portion 132 and a sectional shape of the first bottom surface portions 131 may have a step portion between the sectional shape and a sectional shape of the second bottom surface portion 132. Moreover, the first bottom surface portions 131 may be formed parallel to the agitator shaft 47.

Still further, the first agitating blades and the second agitating blade may be mounted in a state of shifting a phase around the agitator shaft 47 (i.e., in a rotational direction). Also, the first agitating blades and the second agitating blade are paired and plural pairs may be disposed in a state of shifting a phase around the agitator shaft 47.

Still further, although aspects of the present inventive concept have been described in relation to a laser printer, the present inventive concept is not limited to a monochrome laser printer. Rather, the present inventive concept can also be applied to a color laser printer, including a tandem type and an intermediate transfer type printer.

What is claimed is:

1. A developer cartridge comprising:

a cartridge cabinet comprising:

a wall surface;

a developer accommodate chamber that accommodates developer;

a supply opening that is provided in the wall surface and supplies the developer from an inside of the developer accommodate chamber to an outside of the developer accommodate chamber; and a return opening that is provided in the wall surface and returns the developer from the outside of the developer accommodate chamber to the inside of the developer accommodate chamber, wherein the developer cartridge further comprises:

a rotational shaft that is rotatably supported in the cartridge cabinet, extends parallel to the wall surface and penetrates through the inside of the developer accommodate chamber;

a first agitating blade that is attached to the rotational shaft to rotate with the rotational shaft and that is located in a position opposed to the return opening, a distance from the rotational shaft to a distal end of the first agitating blade being shorter than a distance from the rotational shaft to the return opening in a region overlapping the return opening; and a second agitating blade that is attached to the rotational shaft to rotate with the rotational shaft and that is located in a position opposed to the supply opening, a distance from the rotational shaft to a distal end of the second agitating blade being longer than a distance from the rotational shaft to the supply opening.

2. The developer cartridge according to claim 1, wherein:

a width of the second agitating blade along the rotational shaft is longer than a width of the supply opening; and the second agitating blade comprises a plurality of notches that are provided in a region overlapping the return opening and that extend from a distal edge of the second agitating blade toward the rotational shaft, a distance between the notches being shorter than the width of the supply opening.

3. The developer cartridge according to claim 1, wherein a bottom surface of the developer accommodate chamber comprises:

a first bottom surface located at a position opposed to the first agitating blade; and a second bottom surface located at a position opposed to the second agitating blade, wherein the first bottom surface is provided nearer to the rotational shaft than the second bottom surface.

4. The developer cartridge according to claim 3, wherein at least a part of the first agitating blade contacts with the first bottom surface.

5. The developer cartridge according to claim 3, wherein a distance from the rotational shaft to a distal edge of the first bottom surface nearest to the second bottom surface is greater than a distance from the rotational shaft to a distal edge of the first bottom surface nearest to a side wall of the developer cartridge.

6. The developer cartridge according to claim 5, wherein the first bottom surface has a sectional shape inclined up to the second bottom surface as the first bottom surface approaches to the second bottom surface.

7. The developer cartridge according to claim 1, wherein a distance from the rotational shaft to a distal end of the first agitating blade becomes longer from an outside distal edge of the first agitating blade to a distal edge of the first agitating blade nearest to the second agitating blade.

8. The developer cartridge according to claim 7, wherein a length from the rotational shaft to the distal end of the first agitating blade nearest to the second agitating blade is substantially equal to a length from the rotational shaft to the distal end of the second agitating blade nearest to the first agitating blade.

9. The developer cartridge according to claim 1, wherein, in a direction of rotation of the rotating shaft, an end of the first agitating blade nearest to the second agitating blade precedes an end of the first agitating blade farthest from the second agitating blade.

10. The developer cartridge according to claim 1, wherein:

the supply opening is provided at a center in a width direction of the wall surface; and the return opening comprises a plurality of return openings, one return opening provided on either side of the supply opening in the width direction of the wall surface.

11. A developing unit comprising:

a developer cartridge comprising:

a cartridge cabinet comprising:

a wall surface;

a developer accommodate chamber that accommodates developer;

a supply opening that is provided in the wall surface and supplies the developer from an inside of the developer accommodate chamber to an outside of the developer accommodate chamber; and a return opening that is provided in the wall surface and returns the developer from the outside of the developer accommodate chamber to the inside of the developer accommodate chamber, wherein the developer cartridge further comprises:

a rotational shaft that is rotatably supported in the cartridge cabinet, extends parallel to the wall surface and penetrates through the inside of the developer accommodate chamber;

a first agitating blade that is attached to the rotational shaft to rotate with the rotational shaft and that is located in a position opposed to the return opening, a distance from the rotational shaft to an distal end of the first agitating blade being shorter than a distance from the rotational shaft to the return opening in a region overlapping the return opening; and a second agitating blade that is attached to the rotational shaft to rotate with the rotational shaft and that is located in a position opposed to the supply opening, a distance from the rotational shaft to a distal end of the second agitating blade being longer than a distance from the rotational shaft to the supply opening, and wherein the developing unit further comprises a unit cabinet which is attachable to and detachable from the developer cartridge, the unit cabinet comprising:

a developing chamber;

a plurality of openings that are provided in a wall surface of the unit cabinet, a respective one of the plurality of openings located in a position opposite to the supply opening and the return opening of the developer cartridge enable communication between an inside of the developing chamber to the inside of the developer accommodate chamber; and a developer transport member that is provided inside the developing chamber and transports developer supplied from the supply opening to the inside of the developing chamber in a direction along the rotational shaft.

12. An image forming apparatus comprising:

an apparatus body comprising:

a developing unit comprising:

a developer cartridge comprising:

a cartridge cabinet comprising:

a wall surface;

a developer accommodate chamber that accommodates developer;

a supply opening that is provided in the wall surface and supplies the developer from an inside of the developer accommodate chamber to an outside of the developer accommodate chamber; and a return opening that is provided in the wall surface and returns the developer from the outside of the developer accommodate chamber to the inside of the developer accommodate chamber, wherein the developer cartridge further comprises:

a rotational shaft that is rotatably supported in the cartridge cabinet, extends parallel to the wall surface and penetrates through the inside of the developer accommodate chamber;

a first agitating blade that is attached to the rotational shaft to rotate with the rotational shaft and that is located in a position opposed to the return opening, a distance from the rotational shaft to an distal end of the first agitating blade being shorter than a distance from the rotational shaft to the return opening in a region overlapping the return opening; and a second agitating blade that is attached to the rotational shaft to rotate with the rotational shaft and that is located in a position opposed to the supply opening, a distance from the rotational shaft to a distal end of the second agitating blade being longer than a distance from the rotational shaft to the supply opening, and wherein the developing unit further comprises a unit cabinet which is attachable to and detachable from the developer cartridge, the unit cabinet comprising:

a developing chamber;

a plurality of openings that are provided in a wall surface of the unit cabinet, a respective one of the plurality of openings located in a position opposite to the supply opening and the return opening of the developer cartridge enable communication between an inside of the developing chamber to the inside of the developer accommodate chamber; and a developer transport member that is provided inside the developing chamber and transports developer supplied from the supply opening to the inside of the developing chamber in a direction along the rotational shaft.

* * * * *